US006185954B1

(12) United States Patent
Smiley, III et al.

(10) Patent No.: US 6,185,954 B1
(45) Date of Patent: Feb. 13, 2001

(54) TANGENTIAL FAN SCROLL AND DISCHARGED DIFFUSER DESIGN

(75) Inventors: William A. Smiley, III, La Crosse; Glenn J. McClellan, West Salem, both of WI (US)

(73) Assignee: American Standard Inc., Piscataway, NJ (US)

( * ) Notice: Under 35 U.S.C. 154(b), the term of this patent shall be extended for 0 days.

(21) Appl. No.: 09/266,383

(22) Filed: Mar. 11, 1999

Related U.S. Application Data

(62) Division of application No. 09/083,607, filed on May 22, 1998.

(51) Int. Cl.[7] ..... F25D 17/06
(52) U.S. Cl. ..... 62/426
(58) Field of Search ..... 62/404, 411, 426; 454/275

(56) References Cited

U.S. PATENT DOCUMENTS

| | | | | |
|---|---|---|---|---|
| 3,096,931 | * | 7/1963 | Eck | 415/53.3 |
| 3,504,617 | * | 4/1970 | Merklin et al. | 454/236 |
| 4,014,625 | | 3/1977 | Yamamoto | 415/54 |
| 4,264,273 | | 4/1981 | Grzina | 415/197 |
| 4,735,551 | | 4/1988 | Schilling | 415/206 |
| 5,141,397 | | 8/1992 | Sullivan | 415/206 |
| 5,156,524 | | 10/1992 | Forni | 415/182.1 |
| 5,279,515 | | 1/1994 | Moore et al. | 415/119 |
| 5,293,758 | | 3/1994 | Ames et al. | 62/428 |
| 5,570,996 | | 11/1996 | Smiley, III | 415/53.2 |

OTHER PUBLICATIONS

"Self–Contained Unit Ventilator Heat Pump and Air Conditioning Models", UV–DS–2, Jul. 1997, First Printing.
Air Cooled Self–Contained Unit Ventilator Heat Pump and Air Conditioner Models THPB, TACB, TSCB–IOM–1, Jun. 1997.
"Self–Contained Unit Ventilators", MP–S–643.3, May 1997.

* cited by examiner

*Primary Examiner*—William Doerrler
*Assistant Examiner*—Mel Jones
(74) *Attorney, Agent, or Firm*—William J. Beres; William O'Driscoll; Peter D. Ferguson

(57) ABSTRACT

An air conditioning unit comprising: a housing having a first half and a second half; the first half of the housing containing an indoor heat exchange coil and a blower moving air through said coil from at least a housing inlet to a housing outlet. The blower discharges into a diffuser duct having a diffuser section with a first segment and a second segment where the first and second segments have first and second respective and differing angles of diffusion.

13 Claims, 3 Drawing Sheets

TANGENTIAL FAN SCROLL AND DISCHARGED DIFFUSER DESIGN

This application is a division of Ser. No. 09/083,607 filed May 22, 1998.

BACKGROUND OF THE INVENTION

The present invention is directed to an air conditioning system such as a self contained unit ventilator or similar system having a blower or fan discharging air into a discharge duct. More particularly, the present invention is directed to the optimum scroll housing about the fan or blower and to the optimum discharge diffuser design. Alternatively, the invention is also applicable to terminal devices such as fan coil units.

A self contained unit ventilator is a typical packaged air conditioner in that it contains a complete air conditioning system including a serially linked indoor heat exchanger, compressor, outdoor heat exchanger, and an expansion device leading back to the indoor heat exchanger. The outdoor heat exchanger is in fluid communication with outdoor ambient air and, unless the unit ventilator is configured as a heat pump, acts as a condenser. The indoor heat exchanger is in fluid communication with the space to be conditioned and typically acts as an evaporator. The self contained unit ventilator is typically used in classroom or hotel applications and the incremental reduction of size of the unit ventilator provides significant competitive advantages.

Typically the indoor and outdoor sections are separated from each other by a physical barrier and each section includes a blower or fan moving air through the respective indoor or outdoor heat exchanger. For purposes of the present invention, the term blower and the term fan are used interchangeably and are intended to apply to all air moving devices. The blower or fan is often a cross flow tangential blower having a scroll housing about it where the fan's discharge leads into a discharge/diffuser duct. The scroll housing radially expands about the blower and guides the blower's discharge into the diffuser duct. A cutoff separates the blower input from the blower discharge.

It is desirable to minimize the fan's energy consumption while maximizing the diffusion of the fan's output. It is even more important to minimize the generation and radiation of acoustical sounds by the overall unit ventilator and particularly by the blower.

SUMMARY OF THE INVENTION

It is an object, feature and advantage of the present invention to solve the problems of the prior art terminal devices.

It is an object, feature and advantage of the present invention to provide a scroll housing and diffuser duct arrangement for a tangential blower which minimizes energy losses, which minimizes the generation and radiation of acoustic sound, and which maximizes the flow diffusion of the blower's discharge.

It is an object, feature and advantage of the present invention to eliminate the line-of-sight transmission of acoustical sound between an air conditioning blower and a space which is being conditioned.

It is an object, feature and advantage of the present invention to optimize the scroll housing and cutoff to maximize the pressure and flow provided by a tangential fan without increasing the size of the fan.

It is an object, feature and advantage of the present invention to provide a short discharge duct to convert the kinetic energy of the fan discharge velocity into some potential energy through the use of a diffusing section of duct.

It is an object, feature and advantage of the present invention to provide an optimum flow path through a diffusing section of duct so as to minimize energy losses while minimizing flow separation.

The invention applies to all blowers or fans having a scroll housing or a discharge diffuser duct. Such blowers or fans are typically referred to as tangential, centrifugal, squirrel cage, or crossflow blowers or fans. A compact centrifugal fan is shown in U.S. Pat. No. 5,570,996 to Smiley, a centrifugal fan is also shown in U.S. Pat. No. 5,279,515 to Moore et al., and a tangential fan is shown in U.S. Pat. No. 5,293,758 to Ames et al., all of which are commonly assigned with the present invention and hereby incorporated by reference.

The present invention provides an air conditioning unit. The unit comprises a housing having a first half and a second half where the first half of the housing contains an indoor heat exchange coil and a blower moving air through said coil from at least a housing inlet to a housing outlet. The blower discharges into a diffuser duct having a diffuser section with a first segment and a second segment where the first and second segments have first and second respective and differing angles of diffusion.

The invention further provides the second half of the housing containing a compressor and outdoor heat exchange coil; wherein the indoor heat exchange coil, the compressor and the outdoor heat exchange coil are serially linked into an air conditioning circuit.

The present invention further provides a cross flow blower housing. The housing comprises a scroll housing section having an expanding scroll section from a starting line to a finishing line; and a linear housing section contiguous with the finishing line of the scroll housing section and extending linearly therefrom. The housing also includes a cutoff section having a first segment angle at a first angle relative to the linear housing section and having a second segment angle at a second angle relative to the linear housing section.

The present invention also provides a blower having a diameter D and an axis. The blower comprises a scroll housing about the fan having a starting line located a radial distance $R_i$ from the fan axis, and including a scroll expansion section starting at the beginning line and radially expanding in arc to a finishing line $R_f$ relative to the fan axis. The blower includes a linear diffusion segment starting at the finish line and continuing linearly therefrom at a first distance. The blower also includes a fan diffuser arranged to separate a blower intake of the blower from a blower discharge of the blower. The fan diffuser has a cutoff end proximal the blower, a first segment continuing from the cutoff in a direction away from the blower and expanding from the linear portion at a first angle for a first distance, and a second expansion segment located after the first expansion segment and continuous therewith. The second expansion segment expands from the linear portion at a second angle for a second distance.

DETAILED DESCRIPTION OF THE DRAWINGS

Figure 1:
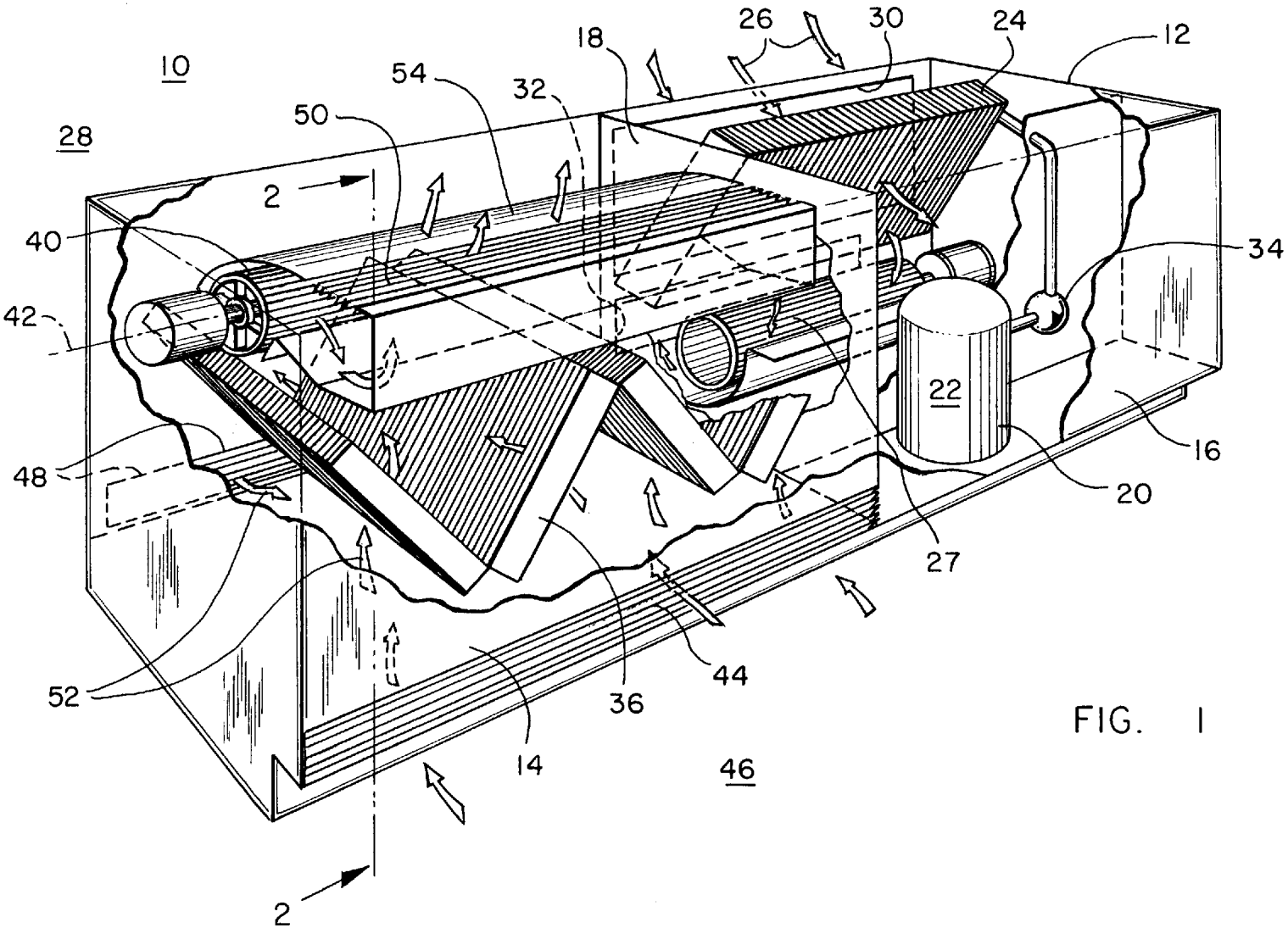
FIG. 1 shows a block drawing of an air conditioning system such as a unit ventilator in accordance with the present invention with the major internal components also displayed.

FIG. 1 shows a self contained air conditioning system 10 such as a unit ventilator. Although shown in the preferred embodiment as a full air conditioning system, the invention relates to the indoor section and thus is applicable to all terminal devices including, for example, fan coil units and the like. The system 10 includes a housing 12 surrounding an indoor section 14 and an outdoor section 16. A barrier 18 separates the indoor section 14 from the outdoor section 16.

The housing 12 preferably contains an air conditioning system 20 including a compressor 22 whose discharge is directed to an outdoor heat exchanger 24 typically acting as a condenser. The compressor 22 and the outdoor heat exchanger 24 are in the outside section 16 and include an airflow path 26 entering from outside ambient air 28 through an outside air inlet aperture 30 passing through the outdoor heat exchanger 24 and returning to the outdoor ambient air 28 through an outside air outlet aperture 32. A blower 27 motivates air through this airflow path 26 and out the outlet aperture 32.

The air conditioning system 20 also includes an expansion device 34 connected to the discharge of the outside heat exchanger and controlling the flow of refrigerant to an indoor heat exchanger 36. The discharge of the indoor heat exchanger 36 returns to the compressor 22. The indoor heat exchanger 36 is located in the indoor section 14, and the expansion device 34 can be located in either the indoor or outdoor section 14, 16.

Figure 2:
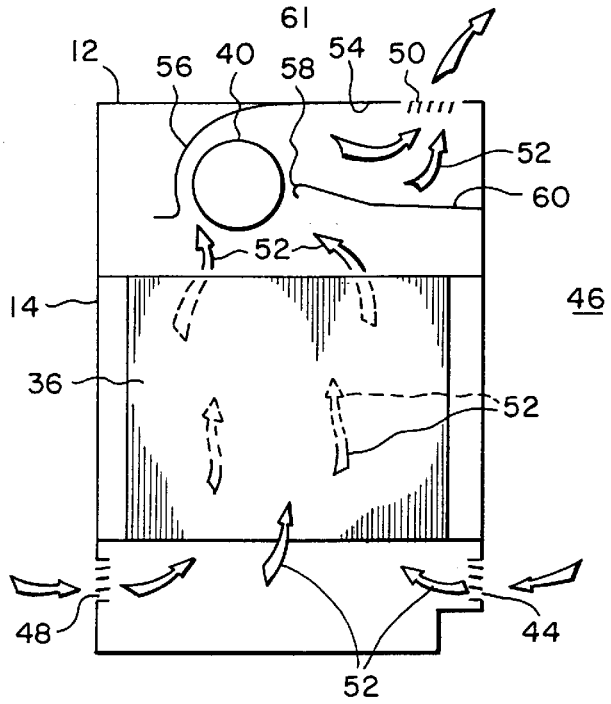
FIG. 2 is a cutaway of FIG. 1 taken along lines 2—2.

Referring to both FIGS. 1 and 2, the indoor section 14 includes a blower 40 having an axis 42 aligned to draw air over the indoor heat exchanger 36. The indoor section 14 includes a return air inlet 44 bringing air from the space 46 to be cooled, an outside air inlet 48 bringing in outside air from ambient air 28, and a supply air discharge duct 54 discharging conditioned supply air back through a discharge aperture 50 into the space 46 to be cooled.

Figure 3:
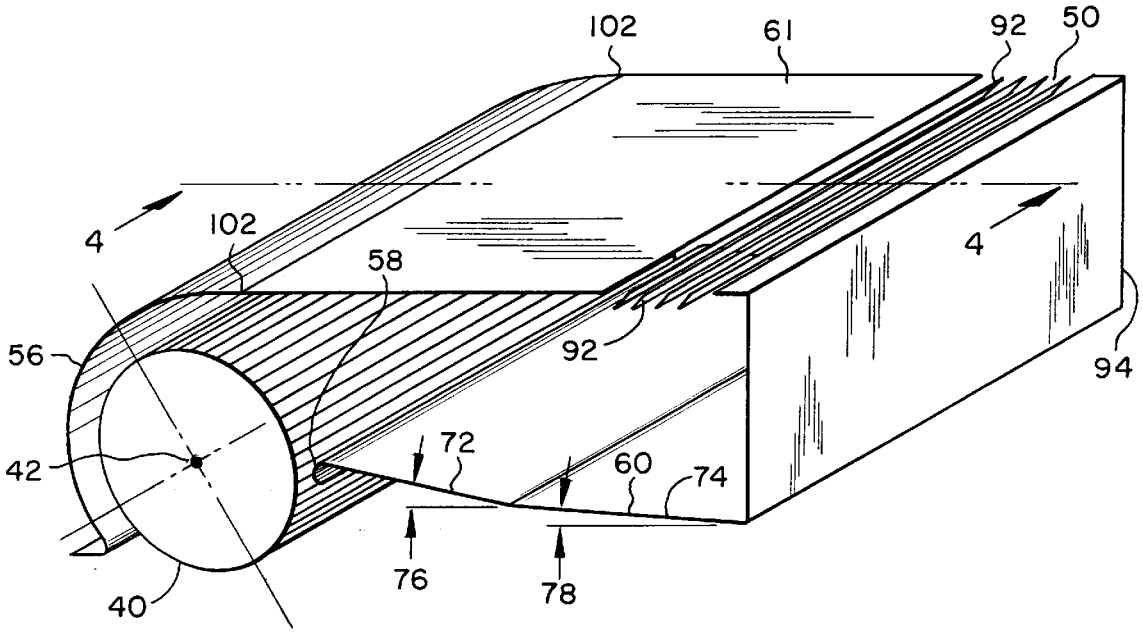
FIG. 3 is a perspective of the tangential blower, the scroll housing, the cutoff and the diffuser section of the present invention as shown in FIG. 2.

Referring now to both FIGS. 1, 2 and 3, an airflow path 52 is provided from the return air inlet 44 and from the outdoor air inlet 48 to pass thru the indoor heat exchangers 36, into the blower 40, through the discharge duct 54 and out the discharge aperture 50. A scroll housing 56 is provided about the blower 40 to direct and control the blower's operation, and a cutoff 58 and a diffuser section 60 are provided to diffuse and direct the fan's discharge through the discharge duct 54 and the discharge aperture 50. Typically, the diffuser section 60 is a planar section which angles away from a planar section 61 of the duct 54, where the planar section 61 lies between the scroll housing 56 and the discharge aperture 50.

Figure 4:
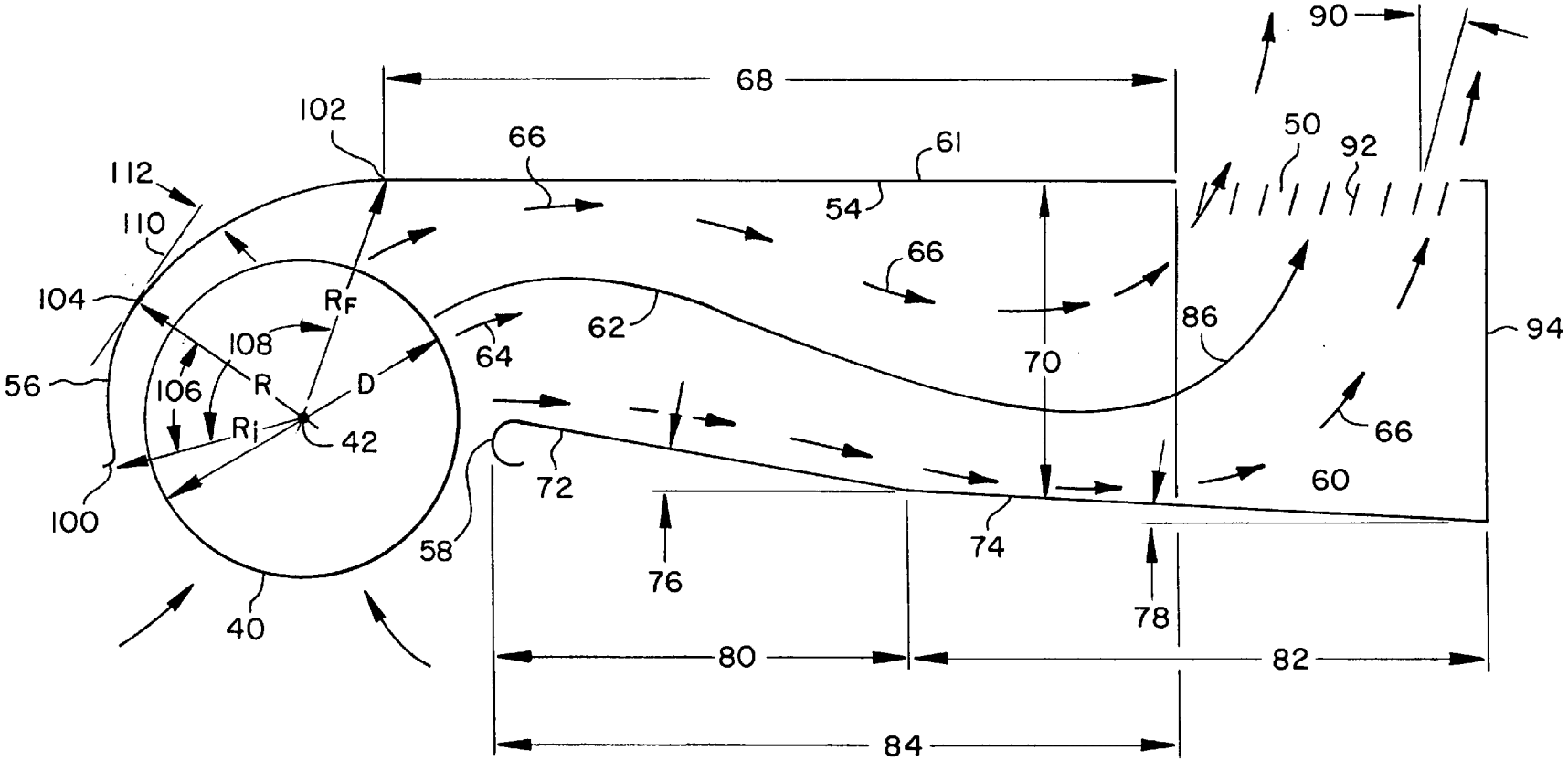
FIG. 4 is a cutaway of FIG. 3 taken along lines 4—4.

The diffuser and scroll geometries of the present invention are discussed in more detail with regard to FIGS. 3 and 4. The blower 40 of the present invention incorporates a significant flow direction change while incurring a minimum energy loss as the air is moved to and through the discharge aperture 50. The invention's geometry maximizes flow diffusion in the diffuser duct 54 while minimizing the generation and radiation of acoustical sound. There is no line-of-sight transmission between the blower 40 and the discharge 50.

The discharge air leaving the blower 40 exhibits a wave-like pattern 62 in the discharge duct 54. This pattern 62 normally dampens out after approximately 3–4 fan diameters D downstream of the blower discharge 64. The pattern 62 has a surrounding flow field 66 which is fairly unstable in the immediate vicinity of the fan wheel discharge 64. If the discharge duct 54 is fairly short such that the length 68 is less than one diameter D, the blower 40 exhibits pulsating pressure and unsteady sound signals. Because of this, it is desirable to apply at least a short discharge duct 54 on the order of 1.5 to 2 blower diameters D, yielding a minimum recommended discharge duct 54 of length equal to 1.5 D.

Also, since the velocity of the fan discharge 64 is necessarily high, as is characteristic of this type of blower 40, it is desirable to convert some of this kinetic energy to potential energy. The most effective method to achieve this conversion is by providing a diffusing section 60 in the duct 54. However, the rate of diffusion provided by the diffuser 60 as the section 60 angles from the planar section 61 is critical. Too rapid expansion of the cross section 70 of the duct 54 promotes flow separation relative to the pattern 62 and increased energy losses. Contrarily, a too slowly expanding cross section 70 of the duct 54 requires more space to achieve the desired velocity changes and can in fact have a negative effect on the diffusion by the increased frictional losses due to the longer flow path. Additionally, any directing or turning of the flow from the normal path incurs energy losses, these losses being a function of geometry, air velocity and turning angle. It is not unusual to incur losses on the order of one or more velocity heads in turning the air 90°.

The present invention proposes more effective diffusion, stabilization and turning of the air in the pattern 62. Specifically, the diffuser 60 includes at least two segments 72, 74 where each segment 72, 74 has a distinct diffuser angle 76, 78 respectively is more practical and approaches the optimum rate of diffuser angle change. For the tangential blower 40 with its wave like discharge airflow pattern 62, the first segment 72 of the diffuser 60 should match the discharge airflow pattern 62 and angle, allowing quasi-neutral direction and some diffusion while the flow 66 is allowed to stabilize. Preferably the angle 76 is approximately 17° for the first segment 72 where the segment 72 has a distance 80 approximately equal to the fan diameter D. This first segment 72 commences at the fan cutoff 58 and continues the direction and slope of the fan cutoff 58 to result in very good flow control, stabilization and diffusion.

The second segment 74 has a diffusion angle 78 which is somewhat less than the diffusion angle 76. The diffusion angle 78 of the second segment 74 is approximately 2°. The length 82 of the second segment 74 is approximately 2.4 diameters D of the blower 40.

This multi-segmented arrangement results in a discharge flow pattern 62 with an initial wave length 84 of about 2.5 diameters D of the blower 40. The next quarter wave length 86 coincides with the turn and exit from the duct 54 through the discharge 50. Consequently, the natural discharge flow angle matches the angle 90 of discharge louvers 92 relative to the vertically aligned duct end 94 to minimize any flow angle change energy loss. Preferably the angle 90 is approximately 10 to 15° from the vertical. The length 68 of the straight section 61 of the discharge duct 54 can be adjusted somewhat to achieve a differing discharge neutral flow angle and the louvers 92 can be adjusted for other angles but incur some additional energy losses if differing from the natural flow direction. This geometric combination of diffuser angle, duct length and discharge area is optimized for the space and discharge velocity and angle. Other requirements could be met by varying the geometric parameters.

The scroll housing 56 is also optimized to provide higher pressure and flow versus current designs while using the same space as the current design. The scroll housing 56 commences at a starting line 100 which is an initial radius $R_i$ from the blower axis 42. The scroll housing 56 radially expands from the starting line 100 to an ending line 102 which is a radial distance $R_f$ from the blower axis 42. The starting line 100 commences the radial expansion of the scroll housing 56, and the ending line 102 indicates the termination of that radial expansion relative to the axis 42. At any particular point 104 on the expansion of the scroll housing 56, the radial distance from the axis 42 is defined by an expansion radius R. Expansion angle 106 defines the angle between the initial radius $R_i$ and the expansion radius R, while terminal angle 108 defines the angle between the initial radius $R_i$ and the final radius $R_f$. Tangent line 110 is a line tangent to the representative point 104 and having a tangent angle 112.

Given the foregoing, the shape of the scroll housing 56 is defined by the equation $$R=R_i e^{Ln(1+2^{\pi}\ Tan(angle\ 112))angle\ 106/360^{\circ}}.$$

Preferably the angular distance between $R_f$ and $R_i$ is 122° as shown by angle 108. Additionally, the ratio of the initial radius $R_i$ to the blower diameter D is preferably 0.563, and the final radius $R_f$ in relation to the blower diameter D is a ratio of 1.103.

The present invention shows a scroll housing and diffuser duct which minimizes the generation and radiation of acoustical noise from the blower while promoting the flow and pressure generated by the fan. It will be apparent to a person of ordinary skill in the art that many variations in this are apparent. All such variations and modifications are contemplated to fall within the spirit and scope of the claimed invention.

What is desired to be secured for Letters Patent of the United States is set forth in the following claims.

What is claimed is:

1. A cross flow blower housing comprising:

a scroll housing section having an expanding scroll section from a starting line to a finishing line;

a linear housing section contiguous with the finishing line of the scroll housing section and extending linearly therefrom; and a cutoff section having a first segment angle at a first angle relative to the linear housing section and having a second segment angle at a second angle relative to the linear housing section.

2. The cross flow blower of claim 1 wherein the blower includes a scroll housing arranged about it and terminating at the diffuser duct, the scroll housing being defined by the following formula:

$$R=R_i e^{Ln(1+2^{\pi}(tan(angle\ x))angle\ Y/360}$$

where R denotes the radial distance of any point on the scroll housing from the blower axis and where $R_i$ denotes the initial radius of the scroll housing from the blower housing, and where angle X is the tangent angle of the respective point relative to the blower housing and where angle Y is the angle from the initial radius $R_i$.

3. The cross flow blower of claim 1 wherein the linear housing section has a length which is 1.5 times the diameter of a blower arranged within the scroll housing section.

4. The cross flow blower of claim 1 wherein the angle of the second segment is less than the angle of the first segment.

5. The cross flow blower of claim 1 further including a discharge duct arranged at an end of the linear housing section away from the scroll housing and including louvers angled at 10 to 15° from the vertical.

6. A blower having a diameter D and an axis comprising:

a scroll housing about the fan having a starting line located a radial distance $R_i$ from the fan axis, and including a scroll expansion section starting at the beginning line and radially expanding in arc to a finishing line $R_f$ relative to the fan axis, and further including a linear diffusion segment starting at the finish line and continuing linearly therefrom at a first distance; and a fan diffuser arranged to separate a blower intake of the blower from a blower discharge of the blower, the fan diffuser having a cutoff end proximal the blower, and a first segment continuing from the cutoff in a direction away from the blower and expanding from the linear portion at a first angle for a first distance, and a second expansion segment located after the first expansion segment and continuous therewith, the second expansion segment expanding from the linear portion at a second angle for a second distance.

7. The blower of claim 6 wherein the first angle is greater than the second angle.

8. The blower of claim 7 wherein the first distance is less than the second distance.

9. The blower of claim 8 wherein the linear distance is a minimum distance of 1.5 times the blower diameter.

10. The blower of claim 9 wherein the first distance is approximately a blower diameter.

11. The blower of claim 10 wherein the second distance is approximately 2.4 times the blower diameter.

12. The blower of claim 11 wherein the first angle is approximately 17° and the second angle is approximately 2°.

13. The blower of claim 12 including a discharge aperture located at an end of the linear portion, the discharge aperture including louvers having an angle of 10 to 15° from the vertical.

* * * * *